US006588378B1

(12) United States Patent
Henderson et al.

(10) Patent No.: US 6,588,378 B1
(45) Date of Patent: Jul. 8, 2003

(54) WATER HEATER BOTTOM PAD/FOAM DAM APPARATUS WITH INTEGRATED TANK SUPPORT MEMBERS

(75) Inventors: David L. Henderson, Millbrook, AL (US); Jozef Boros, Montgomery, AL (US)

(73) Assignee: Rheem Manufacturing Company, New York, NY (US)

( * ) Notice: Subject to any disclaimer, the term of this patent is extended or adjusted under 35 U.S.C. 154(b) by 0 days.

(21) Appl. No.: 10/229,699

(22) Filed: Aug. 28, 2002

(51) Int. Cl.[7] ..... B65D 25/00
(52) U.S. Cl. ..... 122/19.2; 122/494; 220/694.1
(58) Field of Search ..... 122/13.01, 19.2, 122/494; 220/567.3, 495.01, 694.1

(56) References Cited

U.S. PATENT DOCUMENTS 5,134,683 A * 7/1992 Powell ..... 392/449
6,267,261 B1 * 7/2001 Lesage ..... 220/567.3

* cited by examiner

*Primary Examiner*—Gregory Wilson
(74) *Attorney, Agent, or Firm*—Konneker & Smith, P.C.

(57) ABSTRACT

A water heater is provided with a specially designed molded bottom pad/foam dam member formed from a crushable material, such as polystyrene, which is received in a metal bottom pan and has concentric circular grooves formed in its top side to receive circular bottom end edge portions of the tank and outer jacket portions of the water heater. A circumferentially spaced plurality of rigid support members are imbedded in the bottom pad/foam dam member and underlie its tank groove to prevent the tank from crushing the member one of the support members is formed from an electrically conductive material and defines an electrical grounding path between the tank and the bottom pan, and the other support members are formed from a thermally insulative material to inhibit heat loss from the tank to the bottom pan.

43 Claims, 3 Drawing Sheets

WATER HEATER BOTTOM PAD/FOAM DAM APPARATUS WITH INTEGRATED TANK SUPPORT MEMBERS

BACKGROUND OF THE INVENTION

The present invention generally relates to liquid heating apparatus and, in a preferred embodiment thereof, more particularly relates to specially designed bottom pad/foam dam apparatus positionable under the tank and outer jacket portions of a water heater.

As conventionally constructed, a water heater typically has a tank portion adapted to hold a quantity of water to be heated, an outer jacket structure outwardly circumscribing the vertical tank side wall portion and forming an annular insulation space therewith, and a quantity of insulation disposed in this annular space. The bottom end of the tank/jacket structure is typically placed into a circular bottom pan structure and suitably secured thereto.

A common method of placing insulation in the tank/jacket annulus, after a bottom portion of the tank/jacket structure is secured within the bottom pan, is to simply inject liquid foam insulation into the annulus and let the injected foam subsequently harden therein. As is well known in this art, pressurized injected liquid insulation foam has an undesirable propensity for leaking out of the tank/jacket annulus—particularly at the interface between the bottom pan and the bottom tank/jacket portion received therein. In order to contain the injected liquid foam within the tank/jacket annulus, a variety of "dam" structures have previously been utilized to seal various leak paths leading outwardly from the annulus.

To block outward injected foam insulation leakage at the bottom pan, one proposed solution has been to install a bottom pad/foam dam member in the bottom pan and then rest the bottom end portion of the tank/jacket structure on the pad/dam member which is configured to block outward flow of injected foam insulation outwardly from the tank/jacket annulus adjacent the bottom pan. Examples of this technique, utilizing molded polystyrene bottom pad/foam dam structures, may be found in U.S. Pat. No. 5,924,392 to Hall and U.S. Pat. No. 5,154,140 to Windon.

While these previously utilized bottom pad/foam dam structures are generally satisfactory for their intended purpose, they are formed from a "crushable" material (for example, molded polystyrene) which may permit an annular bottom end portion of the tank to crush and cut downwardly through the dam and come into contact with the underlying metal base pan, thereby creating an undesirable thermal leak path between the tank and the base pan. Additionally, the use of this type of bottom pad/foam dam structure has tended to complicate the provision of a desirable electrical grounding path between the tank and the underlying base pan.

A need thus exists for an improved bottom pad/foam structure of the type generally described above. It is to this need that the present invention is primarily directed.

SUMMARY OF THE INVENTION

In carrying out principles of the present invention, in accordance with a preferred embodiment thereof, a liquid heating device, representatively a water heater, is provided with a specially configured bottom pad/foam dam structure that is received in a bottom pan portion of the water heater and is used to support the tank and outer insulation jacket portions of the water heater in a manner operatively positioning the insulation jacket relative to the tank portion and preventing outflow at the bottom pan of liquid foam insulation injected into an insulation space between the jacket and tank portions of the water heater.

The bottom pad/foam dam structure illustratively includes a bottom pad/foam dam member formed from a generally crushable material such as molded polystyrene, the bottom pad/foam dam member being received in the bottom pan and having a top side with a first groove formed therein and receiving an annular lower end edge portion of the tank. To prevent the tank from vertically crushing the pad/dam member a substantially rigid support structure is imbedded in the pad/dam member beneath the first groove and vertically extends between the bottom pan and the bottom side of the first groove.

Preferably, the support structure is defined by a plurality of substantially rigid support members (representatively three in number) which are imbedded in the pad/dam member, are circumferentially spaced apart around the vertical tank axis, and vertically extend from the bottom pan to the bottom side of the first groove. In a preferred embodiment of the support members, one of them is formed from an electrically conductive material and forms an electrical grounding path between the tank and the bottom pan, and the other support members are formed from a thermally insulative material which desirably reduces the downward heat flow between the tank and the bottom pan. Alternatively, the electrical grounding path between the tank and the bottom pan is formed using a vertical metal grounding bolt extending through an upwardly indented central portion of the bottom wall of the pan and threaded into a metal bracket structure secured to the underside of the bottom head portion of the water heater tank.

According to a feature of the invention, the bottom pad/foam dam member is provided with an upwardly projecting foam deflection portion extending around a relatively small portion of its periphery. The deflection portion underlies a foam injection opening formed in a top end portion of the jacket and has circumferentially opposite sides which slope upwardly and circumferentially toward one another to form an apex at the top end of the foam deflection portion. When liquid insulation foam is injected inwardly through the injection opening, the foam impinges on the apex and is circumferentially deflected in opposite directions through the jacket/tank insulation space to facilitate the even circumferential distribution of the injected insulation therein.

In accordance with another aspect of the invention, an upwardly projecting seal tab is formed on a peripheral portion of the bottom pad/foam dam member and is used to form an insulation seal around an outwardly projecting tubular drain fitting on a lower end portion of the tank. The tab is pressed against an inner side surface portion of the jacket and has a horizontal opening therein which press-fittingly and sealingly receives the drain fitting.

In an alternate embodiment of the bottom pad/foam dam structure, an additional top side groove is formed in the pad/dam member to receive an annular bottom end edge portion of a differently sized tank. Accordingly, the same pad/dam member may be used in conjunction with two different water heaters having differently sized tank portions in this alternate embodiment of the bottom pad/foam dam structure the substantially rigid support members are each configured to underlie circumferential portions of each of the two tank edge grooves.

DETAILED DESCRIPTION

Figure 1:
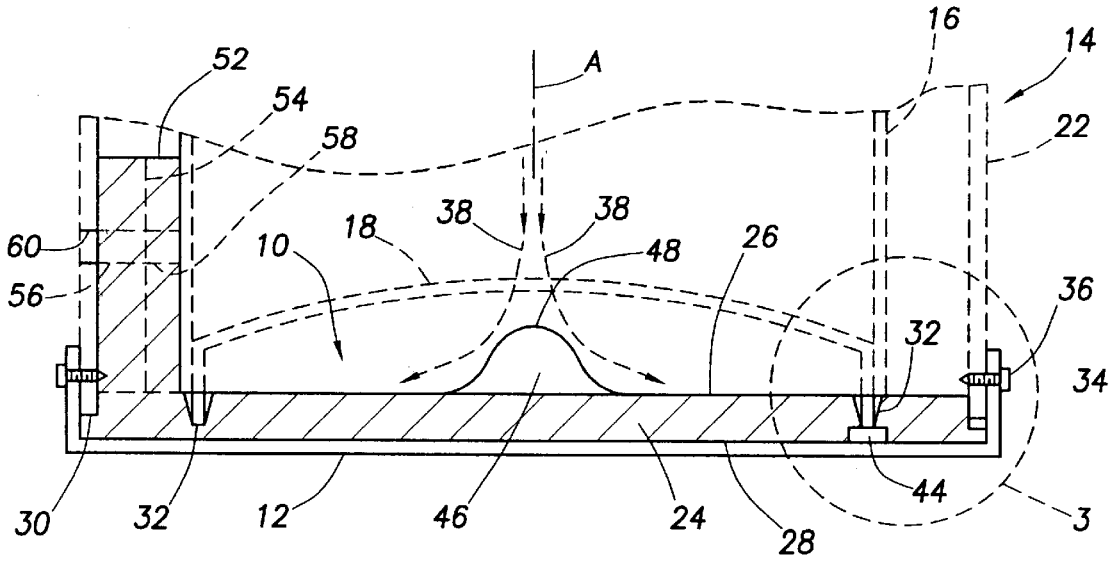
FIG. 1 is a partially phantomed simplified cross-sectional view through a bottom end portion of a representative water heater having incorporated therein a specially designed bottom pad/foam dam structure embodying principles of the present invention.

As illustrated in FIGS. 1–3A of the accompanying drawings, in a preferred embodiment thereof the present invention provides a specially configured circular bottom pad/foam dam structure 10 which is positioned within a circular bottom pan portion 12 of a vertically oriented water heater 14 having a cylindrical configuration water heater 14 has a cylindrical inner metal tank structure 16 for storing heated water, the tank structure 16 being operatively positioned about a vertical axis A and having an upwardly domed bottom head portion 18 and an annular vertical bottom end lip or edge portion 20. A hollow cylindrical outer metal jacket 22 outwardly circumscribes the tank 16. Suitable heating means (not shown) are also provided for heating water disposed in the tank 16 to a predetermined set point temperature.

The bottom pad/foam dam structure 10 includes a generally disc-shaped bottom pad/foam dam member 24 having opposite top and bottom sides 26,28 and being formed from a crushable material, representatively a molded polystyrene material although a variety of other materials could be used if desired concentric annular grooves 30 and 32, centered about the axis A, are formed in the top side 26 of the member 24, with the groove 30 being located at the outer periphery of the member 24, and the groove 32 being disposed radially inwardly of the groove 30.

Figure 3A:
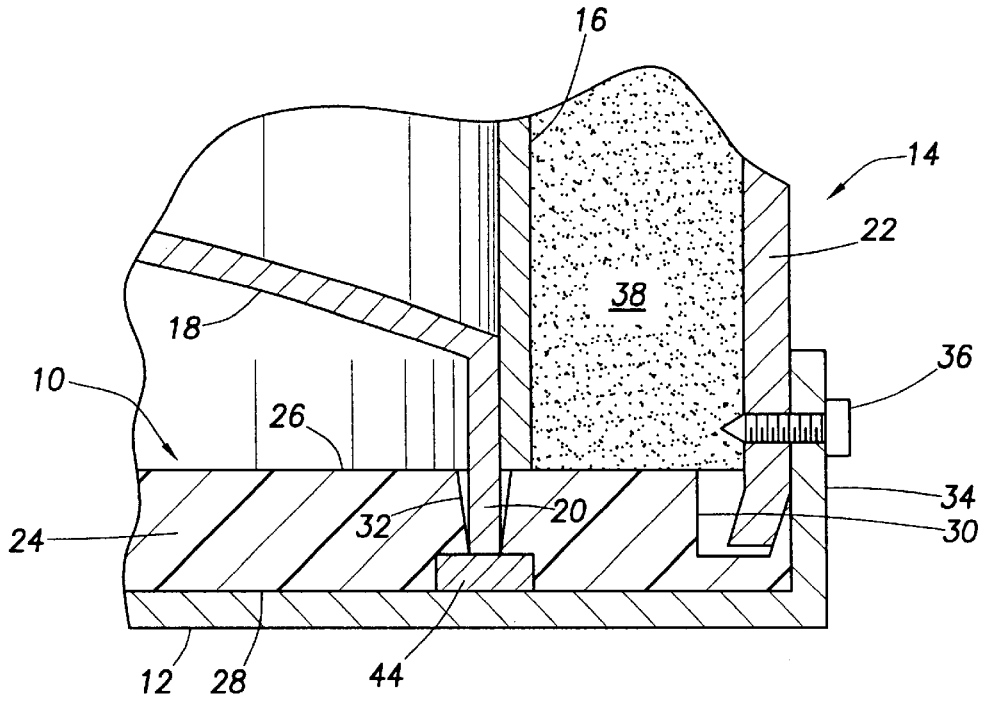
FIG. 3A is an enlarged scale detail view of the dashed circle area "3" in FIG. 1.

In constructing the water heater 14, as shown in FIG. 3A, the bottom pad/foam dam member 24 is complementarily placed top side 26 up in the bottom pan 12, the annular bottom end edge portion 20 of the tank 16 is placed in the annular groove 32 of the pad/dam member 24, and an annular lower end edge portion of the outer metal jacket 22 is placed in the pad/dam member groove 30 and suitably secured to the annular vertical side wall 34 of the bottom pan 12, as by screws 36. Liquid foam insulation 38 is then injected into the annular space between the jacket 22 and the tank 16, in a manner subsequently described herein, and allowed to cure.

The molded bottom pad/foam dam member 24, as can be seen in FIG. 3A, thus acts as a receiving and positioning base for the tank and jacket portions 16,22 of the water heater 14, as well as serving as a dam device for preventing the injected foam insulation 38 from being forced into the area between the top side 26 of the pad/dam member 24 and the underside of the bottom head portion 18 of the tank 16, and/or outwardly between the jacket 22 and the vertical side wall portion 34 of the bottom pan 12.

According to a feature of the present invention, to keep the weight of the tank 16 from vertically crushing the pad/dam member 24, and thereby undesirably bringing the tank into direct heat conducting contact with the bottom pan 12, a specially designed rigid support structure is imbedded in the pad/dam member 24 and underlies the annular groove 32. Representatively, this support structure is defined by a plurality of substantially rigid support members (illustratively three in number) 40,42,44 that are circumferentially spaced apart around the axis A, underlie the pad/dam member top side groove 32, and vertically extend from the bottom side of the groove 32 to the bottom wall of the pan 12.

Representatively, the support members 40,42,44 have rectangular block configurations, but could alternatively have other suitable configurations if desired. The support members 40,42,44 may be molded integrally with the bottom pad/foam dam member 24, or may be inserted into suitable openings therein after the pad/dam member 24 is fabricated. In the illustrated embodiment of the rigid support structure, the support members 42,44 are formed from a thermally insulative material, for example a hard molded plastic material such as polyethylene or polypropylene, and inhibit downward heat transfer therethrough from the tank 16 to the bottom pan 12. The support member 44 is representatively formed from an electrically conductive metal material, illustratively copper, and conveniently defines an electrical grounding path between the tank 16 and the bottom pan 12 without the usual necessity of providing a grounding clip structure on the bottom pan 12.

According to another feature of the invention the bottom pad/foam dam member 10 is provided with a foam deflection portion 46 which projects upwardly from a relatively small circumferential portion of the periphery of the pad/dam member 10 between its concentric annular top side grooves 30 and 32. As best illustrated in FIG. 1, opposite circumferential sides of the projection 46 are sloped upwardly and circumferentially inwardly (i.e., toward one another) to define a rounded apex portion 48 at the upper end of the projection 46.

When the liquid foam insulation 38 is forced into the annular space between the tank 16 and the jacket 22 it is injected downwardly through an injection opening 50 (schematically depicted in FIG. 2) formed in a top end of the jacket 22 and positioned directly above the apex portion 48 of the foam deflection projection 46. As the injected foam insulation 38 downwardly contacts the projection 46 the insulation is deflected from the projection 46 in opposite circumferential directions within the tank/jacket insulation cavity to thereby desirably even out the injected insulation flow around the circumference of such cavity as the insulation enters it.

Figure 2:
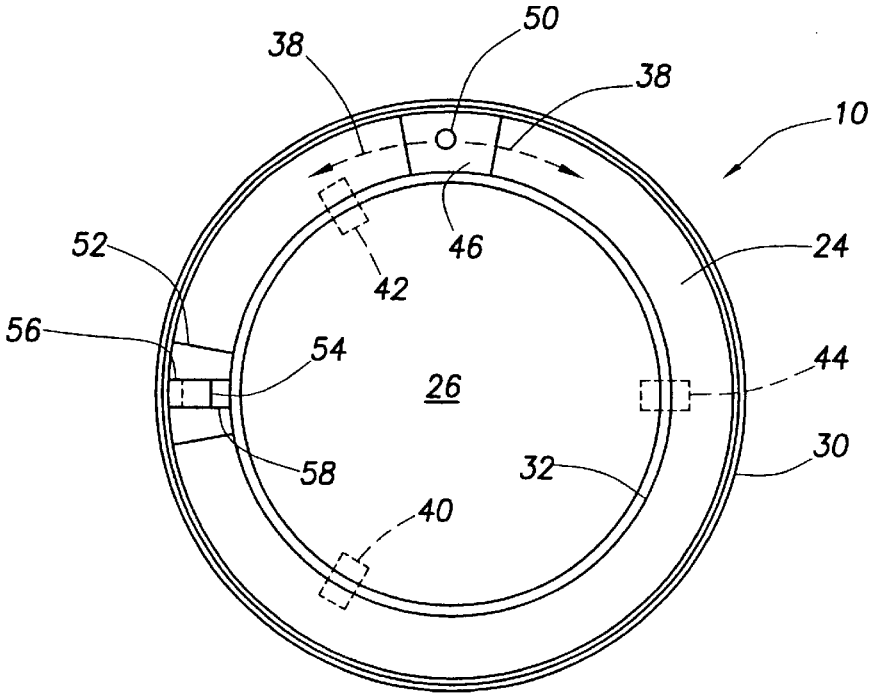
FIG. 2 is a reduced scale top plan view of the bottom pad/foam dam structure removed from the water heater.

As illustrated in FIGS. 1 and 2, in accordance with another feature of the invention, the bottom pad/foam dam member 24 is provided with a sealing tab 52 that projects upwardly from a relatively small circumferential portion of its periphery between the concentric annular top side grooves 30 and 32. A vertically extending groove 54 is formed on the radially inner side of the tab 52 and communicates with a circular opening 56 extending between the groove 54 and the radially outer side of the tab 52. The tab 52 is used in a manner which will now be described to form an insulation seal at a tubular drain fitting 58 projecting horizontally outwardly from a lower end portion of the tank 16.

To operatively construct the water heater 14 in a manner facilitating the use of the seal tab 52, the bottom pad/foam dam structure 10 is placed in the bottom pan 12, and the tank 16 is temporarily positioned horizontally. The bottom pan/foam dam subassembly is then operatively positioned against the bottom side of the tank 16 in a manner such that the drain fitting 58 passes through the tab groove 54 (which facilitates the proper circumferential alignment between the fitting 58 and the tab 52) until the fitting 58 is aligned with the circular tab opening 56. The tab 52 is then pushed inwardly toward a side portion of the tank 16 to cause the fitting 58 to be received in an interference sealing fit within the opening 56.

The tank 16 is then tipped upwardly to rest on the bottom pad/foam dam structure 10. Finally, the jacket 22 is installed around the tank 16. This horizontally compresses the sealing tab 52 between the tank 16 and the jacket 22, thereby forming a seal on an interior side surface portion of the jacket 22 around a circular opening 60 formed therein which is in alignment with the tab opening 56. The foam insulation 38 may then be injected into the annular space between the tank 16 and the jacket 22, the sealing tab 52 preventing the outflow of injected insulation through the jacket opening 60. A suitable drain valve structure (not shown) may then be operatively connected to the drain valve fitting 58 through the jacket and tab openings 60 and 56.

Figure 3B:
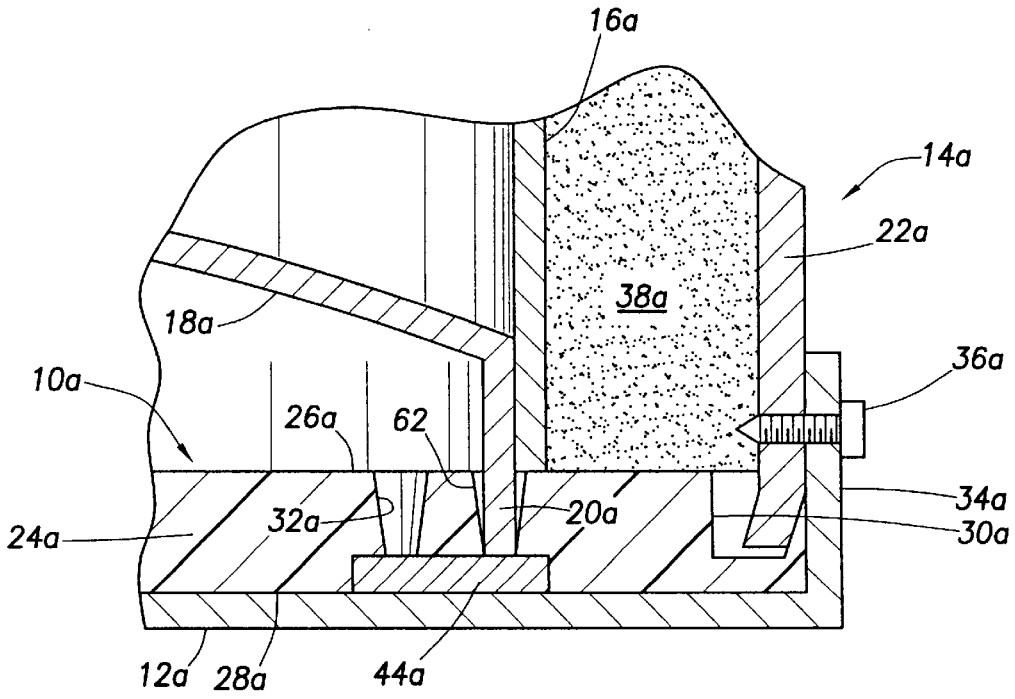
FIG. 3B is a detail view similar to that in FIG. 3A, but with a differently configured water heater operatively supported on an alternate embodiment of the bottom pad/foam dam structure.

A lower portion of an alternate embodiment 14*a* of the previously described water heater 14 is cross-sectionally illustrated in FIG. 3B. In order to facilitate a comparison of the water heaters 14 and 14*a*, components in the water heater 14*a* similar to those in the water heater 14 have been given identical reference numerals with the subscripts "a".

The water heater 14*a* has a tank portion 16*a* having a larger diameter than the previously described tank 16, with the lower annular edge portion 20*a* of the tank 6*a* being received in an additional annular top side groove 62 disposed between the grooves 30*a* and 32*a*. As can be seen by comparing FIGS. 3A and 3B, the provision in the bottom pad/foam dam member 24*a* of the additional annular top side groove 62 permits tile same bottom pad/foam dam structure 10*a* to be used with either of the differently sized tanks 16,16*a* thereby desirably simplifying the overall water heater manufacturing process. To accommodate the addition of this additional tank edge groove 62 to the bottom pad/foam dam member 24*a*, the support member 44*a* and the other two support members 40*a*,42*a* which are not visible in FIG. 3B are radially widened so as to supportingly underlie circumferential portions of each of the top side tank edge grooves 32*a* and 62.

As previously described in conjunction with the water heater 14 shown in FIG. 1, by forming one of the support members (for example, support member 44) from an electrically conductive material, an electrical grounding pan 12 between the metal tank 16 and the underlying metal bottom pan 12 is automatically created when the tank is operatively installed atop the bottom pad/foam dam member 24. However, If desired, all of the support members 40,42,44 shown in FIG. 1 could be of an electrically non-conductive material, and an alternative tank/bottom pan grounding structure, such as the specially designed grounding structure 64 schematically depicted in FIG. 4, could be utilized.

Figure 4:
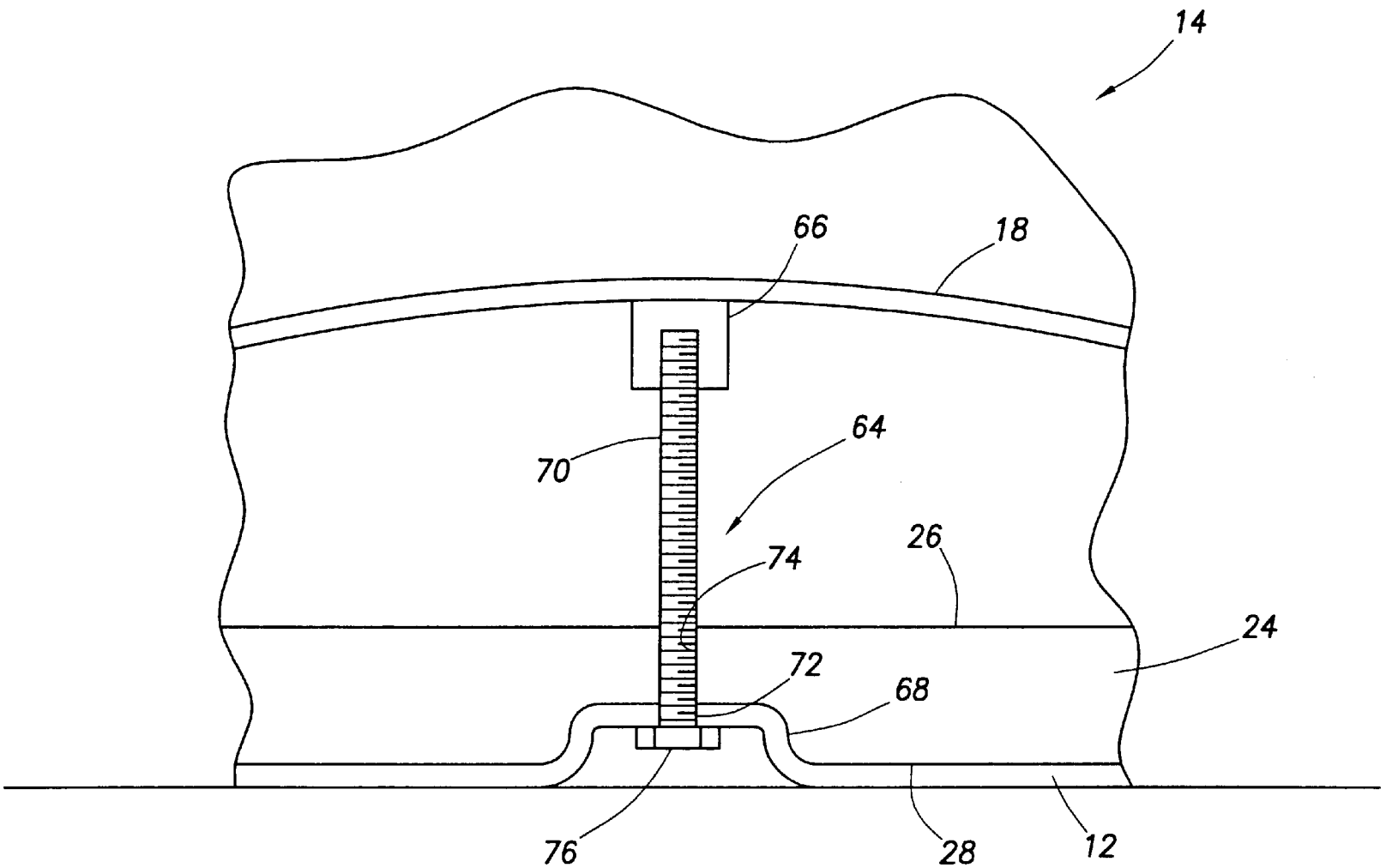
FIG. 4 is an enlarged scale simplified cross-sectional view through a central bottom end portion of the FIG. 1 water heater illustrating an alternate method of providing an electrical grounding path between the metal tank and bottom portions of the water heater.

Referring now to FIG. 4, the grounding structure 64 representatively includes a schematically depicted metal bottom head bracket 66 conductively secured to a central underside portion of the tank bottom heat portion 18, an upwardly indented cylindrical portion 68 of the bottom pan 12 that underlies the bottom head bracket 66 and is received in a complementarily configured bottom side indentation in the pad, and a metal serrated heat shoulder bolt 70 with self-tapping threads. Bolt 70 extends upwardly through circular openings 72,74 in the indented bottom pan portion 68 and the bottom pad/foam dam member 24 and is threaded into the bracket 66 with the head 76 of the bolt 70 conductively engaging the upper end of the bottom pan indentation as shown in FIG. 4. Bracket 66 and bolt 70 thus form an electrical grounding path between the bottom head portion 18 of the water heater tank and the underlying bottom pan 12.

The foregoing detailed description is to be clearly understood as being given by way of illustration and example only, the spirit and scope of the present invention being limited solely by the appended claims.

What is claimed is:

1. A liquid heating device comprising:

a tank structure extending along a vertical axis and adapted to contain a quantity of liquid to be heated, said tank structure having a bottom vertical end edge portion circumscribing said axis;

a jacket outwardly circumscribing said tank structure and forming an insulation space therebetween, said jacket having a bottom vertical end edge portion circumscribing said axis;

a bottom pan; and a bottom pad/foam dam structure including:

a bottom pad/foam dam member formed from a generally crushable material, said bottom pad/foam dam member being received in said bottom pan and having a top side with a first groove formed therein and receiving said end edge portion of said tank structure, and a substantially rigid support structure imbedded in said bottom pad/foam dam member beneath said first groove and supporting said tank structure in a manner preventing it from vertically crushing said bottom pad/foam dam member.

2. The liquid heating device of claim 1 wherein said support structure is defined by a plurality of substantially rigid support members imbedded in said bottom pad/foam dam member, said support members being spaced apart around said axis beneath said first groove and vertically extending from said bottom pan to the bottom side of said first groove.

3. The liquid heating device of claim 2 wherein:

said tank structure and said bottom pan are each of a metal construction, and one of said plurality of support members is of an electrically conductive material, directly contacts said bottom end edge of said tank structure and said bottom pan, and defines an electrical grounding path between said tank structure and said bottom pan.

4. The liquid heating device of claim 3 wherein said electrically conductive material is a metal material.

5. The liquid heating device of claim 2 wherein at least one of said support members is formed from a thermally insulative material.

6. The liquid heating device of claim 5 wherein said thermally insulative material is a plastic material.

7. The liquid heating device of claim 2 wherein there are three of said support members equally spaced about said axis.

8. The liquid heating device of claim 2 wherein said support members are molded integrally with said bottom pad/foam dam member.

9. The liquid heating device of claim 1 wherein said liquid heating device is a water heater.

10. The liquid heating device of claim 1 further comprising a hardened foam insulation material disposed in said insulation space.

11. The liquid heating device of claim 1 wherein said first groove has a circular configuration.

12. The liquid heating device of claim 1 wherein bottom pad/foam dam member is of a molded construction.

13. The liquid heating device of claim 1 wherein said bottom pad/foam dam member is of a molded polystyrene material.

14. The liquid heating device of claim 1 wherein said bottom pad/foam dam member has a circular, generally disc-shaped configuration.

15. The liquid heating device of claim 1 further comprising a second groove formed in said top side, outwardly circumscribing said first groove, and receiving said end edge portion of said jacket.

16. The liquid heating device of claim 9 further comprising a third groove formed in said top side, said third groove being concentric with said first and second grooves, configured to receive a lower end edge portion of a differently sized tank structure, and being horizontally disposed between said first and second grooves, said support structure additionally underlying said third groove.

17. The liquid heating device of claim 9 further comprising a third groove formed in said top side, said third groove being concentric with said first and second grooves, configured to receive a lower end edge portion of a differently sized tank structure, and being disposed horizontally inwardly of said first groove, said support structure additionally underlying said third groove.

18. The liquid heating device of claim 1 wherein said bottom pad/foam dam member has, around only a circumferential portion of its periphery, an upwardly projecting portion extending past said top side and being disposed between said tank structure and said jacket.

19. The liquid heating device of claim 18 wherein said upwardly projecting portion is an insulation deflection portion having an upwardly and circumferentially inwardly tapered configuration.

20. The liquid heating device of claim 18 wherein:

said tank structure has a horizontally extending, outwardly projecting drain fitting on a lower end portion thereof, and said upwardly projecting portion of said bottom pad/foam dam member has a vertical groove formed on a horizontally inner side surface thereof and receiving said drain fitting, and a horizontal opening sealingly receiving an outer end portion of said drain fitting.

21. The liquid heating device of claim 1 further comprising:

an electrical grounding structure providing an electrical grounding path between said tank structure and said bottom pan.

22. The liquid heating device of claim 21 wherein said electrical grounding structure includes:

an electrical grounding member forming a vertical electrical grounding path between horizontally central portions of said bottom pan and said tank structure.

23. The liquid heating device of claim 22 wherein:

said tank structure has a bottom head portion, said bottom pan has a bottom wall with an upwardly offset central portion, said electrical grounding member is an elongated threaded structure, and said electrical grounding structure further includes an electrically conductive structure secured to the underside of said bottom head portion, said elongated threaded structure extending upwardly through said upwardly offset central portion of said bottom wall of said bottom pan and being threaded into said electrically conductive structure.

24. The liquid heating device of claim 23 wherein:

said elongated threaded structure is a serrated head shoulder bolt with self-tapping threads.

25. A bottom pad/foam dam structure upon which a vertically orientable liquid heating device may be operatively supported, the liquid heating device having a bottom vertical tank end edge portion outwardly circumscribed by a bottom vertical insulation jacket end edge portion, said bottom pad/foam dam structure comprising:

a bottom pad/foam dam member formed from a crushable material and having parallel opposite top and bottom sides generally transverse to an axis, and a first groove formed in said top side, extending around said axis, and being configured to receive said bottom vertical tank end edge portion; and a substantially rigid support structure imbedded in said bottom pad/foam dam member beneath said first groove.

26. The bottom pad/foam dam structure of claim 25 wherein said support structure is defined by a plurality of substantially rigid support members imbedded in said bottom pad/foam dam member, said support members being spaced apart around said axis and vertically extending between said bottom side of said bottom pad/foam dam member and the bottom side of said first groove.

27. The bottom pad/foam dam structure of claim 26 wherein one of said plurality of support members is of an electrically conductive material and is exposed at the bottom sides of said first groove and said bottom pad/foam dam member.

28. The bottom pad/foam dam structure of claim 27 wherein said electrically conductive material is a metal material.

29. The bottom pad/foam dam structure of claim 26 wherein at least one of said support members is formed from a thermally insulative material.

30. The bottom pad/foam dam structure of claim 29 wherein said thermally insulative material is a plastic material.

31. The bottom pad/foam dam structure of claim 26 wherein said support members are molded integrally with said bottom pad/foam dam member.

32. The bottom pad/foam dam structure of claim 28 wherein said first groove has a circular configuration.

33. The bottom pad/foam dam structure of claim 25 wherein said bottom pad/foam dam member is of a molded construction.

34. The bottom pad/foam dam structure of claim 25 wherein said bottom pad/foam dam member is of a molded polystyrene material.

35. The bottom pad/foam dam structure of claim 25 wherein said bottom pad/foam dam member has a circular, generally disc-shaped configuration.

36. The bottom pad/foam dam structure of claim 25 further comprising a second groove formed in said top side, outwardly circumscribing said first groove, and being configured to receive said end edge portion of said jacket.

37. The bottom pad/foam dam structure of claim 36 further comprising a third groove formed in said top side, said third groove being concentric with said first and second grooves, configured to receive a lower end edge portion of a differently sized tank structure, and being disposed horizontally inwardly of said first groove, said support structure additionally underlying said third groove.

38. The bottom pad/foam dam structure of claim 25 wherein said bottom pad/foam dam member has, around only a circumferential portion of its periphery, an upwardly projecting portion extending past said top side and being disposed horizontally outwardly of said first groove.

39. The bottom pad/foam dam structure of claim 38 wherein said upwardly projecting portion is an insulation deflection portion having an upwardly and circumferentially inwardly tapered configuration.

40. The bottom pad/foam dam structure of claim 38 wherein said upwardly projecting portion of said bottom pad/foam dam member has a vertical groove formed on a horizontally inner side surface thereof, and a horizontal opening extending outwardly from said inner side surface.

41. The bottom pad/foam dam structure of claim 25 wherein:

said bottom pad/foam dam member has a centrally disposed indentation in said bottom side thereof, with an opening extending between said top side of said bottom pad/foam dam member and the top side of said indentation.

42. A method of constructing a liquid heating device comprising the steps of:

providing a bottom pan having an open top side;

inserting a bottom pad/foam dam structure in said bottom pan, said bottom pad/foam dam structure having a periphery from which a projection upwardly extends, said projection having an upwardly and inwardly tapered configuration;

positioning a liquid storage tank on said bottom pad/foam dam structure horizontally inwardly of said projection;

positioning a jacket structure on said bottom pad/foam dam structure outwardly around said storage tank and horizontally outwardly of said projection, said jacket structure forming with said storage tank an insulation space which outwardly circumscribes said storage tank;

injecting a liquid foam insulation material downwardly through said insulation space from a location above said projection; and causing the injected insulation to contact the upper end of said projection in a manner causing the projection to deflect the insulation in circumferentially opposite directions within said insulation space.

43. A method of constructing a liquid heating device comprising the steps of:

providing a bottom pan having an open top side;

inserting a bottom pad/foam dam structure in said bottom pan, said bottom pad/foam dam structure having a periphery from which a peripheral projection upwardly extends, said projection having an interior side along which a groove vertically extends, and an opening extending horizontally outwardly through said interior side;

providing a liquid storage tank having, on a lower end portion thereof, an outwardly projecting drain fitting with an outer end;

positioning said liquid storage tank on said bottom pad/foam dam structure horizontally inwardly of said projection, with said drain fitting being received in said groove and said outer end of said drain fitting sealingly received in said opening in said projection; and outwardly circumscribing said liquid storage tank with a jacket structure positioned outwardly of said projection and having an opening aligned with said opening in said projection.

* * * * *